US006550437B2

(12) United States Patent
Nakamura et al.

(10) Patent No.: US 6,550,437 B2
(45) Date of Patent: Apr. 22, 2003

(54) VARIABLE-VALVE-ACTUATION APPARATUS FOR INTERNAL COMBUSTION ENGINE

(75) Inventors: Makoto Nakamura, Kanagawa (JP); Shinichi Takemura, Yokohama (JP)

(73) Assignees: Unisia Jecs Corporation, Atsugi (JP); Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/072,910

(22) Filed: Feb. 12, 2002

(65) Prior Publication Data

US 2002/0117134 A1 Aug. 29, 2002

(30) Foreign Application Priority Data

Feb. 28, 2001 (JP) ..... 2001-054172

(51) Int. Cl.[7] ..... F01L 13/00
(52) U.S. Cl. ..... 123/90.16; 123/90.6
(58) Field of Search ..... 123/90.27, 90.6, 123/90.15, 90.16, 90.17, 90.18

(56) References Cited

U.S. PATENT DOCUMENTS

| | | | | |
|---|---|---|---|---|
| 5,085,182 A | | 2/1992 | Nakamura et al. | 123/90.16 |
| 5,988,125 A | | 11/1999 | Hara et al. | 123/90.16 |
| 6,029,618 A | | 2/2000 | Hara et al. | 123/90.16 |
| 6,032,624 A | * | 3/2000 | Tsuruta et al. | 123/90.16 |
| 6,041,746 A | | 3/2000 | Takemura et al. | 123/90.16 |
| 6,055,949 A | | 5/2000 | Nakamura et al. | 123/90.16 |
| 6,123,053 A | | 9/2000 | Hara et al. | 123/90.16 |
| 6,260,523 B1 | | 7/2001 | Nakamura et al. | 123/90.15 |
| 6,390,041 B2 | * | 5/2002 | Nakamura et al. | 123/90.15 |

* cited by examiner

*Primary Examiner*—Thomas Denion
*Assistant Examiner*—Kyle M. Riddle
(74) *Attorney, Agent, or Firm*—Foley & Lardner

(57) ABSTRACT

A VVA apparatus for an internal combustion engine includes a intake valve, and an alteration mechanism which variably controlling lift characteristics of the intake valve in accordance with the engine operating conditions, wherein the valve lift characteristics include a ramp period which is shorter in the range of medium lift amount than in the range of small lift amount and the range of large lift amount.

19 Claims, 11 Drawing Sheets

VARIABLE-VALVE-ACTUATION APPARATUS FOR INTERNAL COMBUSTION ENGINE

BACKGROUND OF THE INVENTION

The present invention relates to a variable-valve-actuation (VVA) apparatus for internal combustion engines, which can vary the lift amount of engine valves such as intake valve and exhaust valve in accordance with the engine operating conditions.

As is well known, the intake and exhaust valves are opened and closed by a cam shaped, e.g. like a raindrop and fixed to a camshaft rotated in synchronism with a crankshaft. The cam has an outer periphery or profile with which a base circle face for zero-lift period, a ramp face for ramp or cushioning period connected to the base circle face, and a lift face or event portion for lift period connected to the ramp face are formed continuously.

The ramp period includes an up-lift period at rising of the valve lift and a down-lift period at termination of the valve lift, during which the lift rising velocity and the lift lowering velocity are restrained to small values, respectively. Such small lift velocity allows cushioning of an excessive impact stress applied on the intake valve or the exhaust valve.

Recently, there are provided internal combustion engines which comprise a VVA apparatus including an alteration mechanism for variably controlling the valve lift amount in accordance with the engine operating conditions.

The VVA apparatus comprises a low-velocity cam, a medium-velocity cam, and a high-velocity cam disposed adjacent to each other and fixed to a camshaft rotated in synchronism with a crankshaft. The cams having different profiles are selectively switched in accordance with the engine operating conditions to change the height of the lift face for enhancement of the engine performance.

For the ramp period, the profile of each cam is established to provide cushioning. However, a specific influence on the engine performance due to the ramp period is not considered to a sufficient degree.

Specifically, during the ramp period, the low-velocity cam for use in the low-rotation low-load range including idle running produces impact noise such as lift starting noise at opening of the engine valve or seating noise at closing thereof, which is heard relatively loudly since drive noise of the whole engine is small in this operating range.

Moreover, the high-velocity cam for use in the high-rotation range produces; loud noise due to unusual behavior of the engine valve such as bounce or jump, which cannot be restrained since the valve-lift starting velocity and the engine-valve seating velocity are very high in this operating range.

Further, in the medium-rotation high-load range having less possibility of occurrence of singular noise to be produced in the above two ranges, the engine valves suffer substantially advanced opening timing and substantially delayed closing timing, leading to deterioration of the intake and exhaust efficiency.

SUMMARY OF THE INVENTION

It is, therefore, an object of the present invention to provide a VVA apparatus for internal combustion engines, which contributes to a reduction in impact noise in the low-rotation low-load range and prevention of unusual behavior of the engine valves in the high-rotation range with enhanced intake and exhaust efficiency in the medium-rotation and high-load range, etc.

The present invention provides generally a variable-valve-actuation (VVA) apparatus for an internal combustion engine, comprising: a valve; and a mechanism which variably lift characteristics of the valve in accordance with operating conditions of the engine, wherein the lift characteristics include a ramp period which is shorter in a range of medium lift amount than in a range of small lift amount and a range of large lift amount.

BRIEF DESCRIPTION OF THE DRAWINGS

The other objects and features of the present invention will be apparent, from the description with reference to the accompanying drawings wherein.

DETAILED DESCRIPTION OF THE INVENTION

Figure 1:
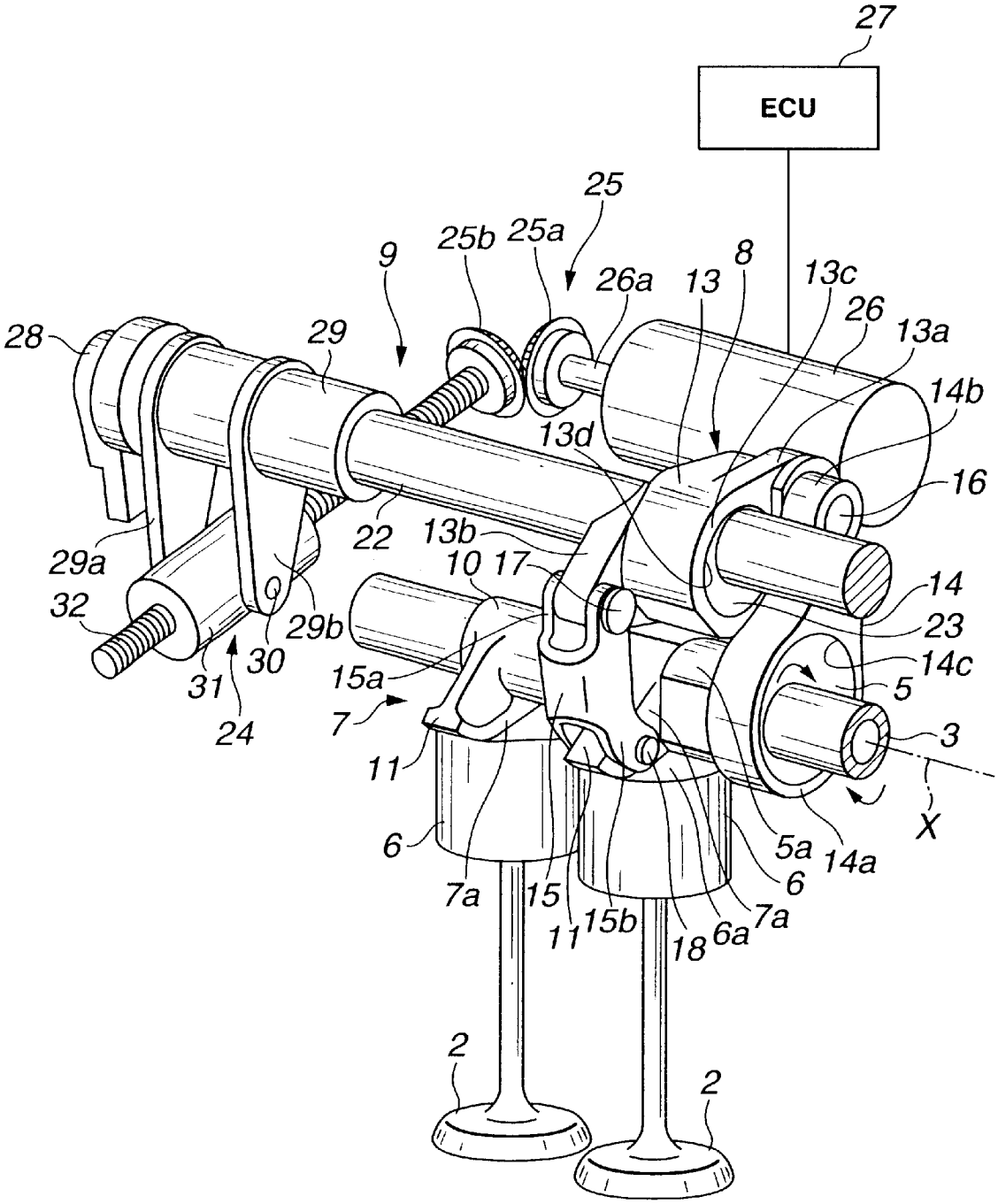
FIG. 1 is a perspective view showing a first embodiment of a VVA apparatus for an internal combustion engine according to the present invention.

Referring to the drawings, a description will be made with regard to a VVA apparatus for an internal combustion engine embodying the present invention. In illustrative embodiments, the VVA apparatus is applied to the intake side, and comprises two intake valves per cylinder and an alteration mechanism for varying the lift amount of the intake valves in accordance with the engine operating conditions.

Figure 4:
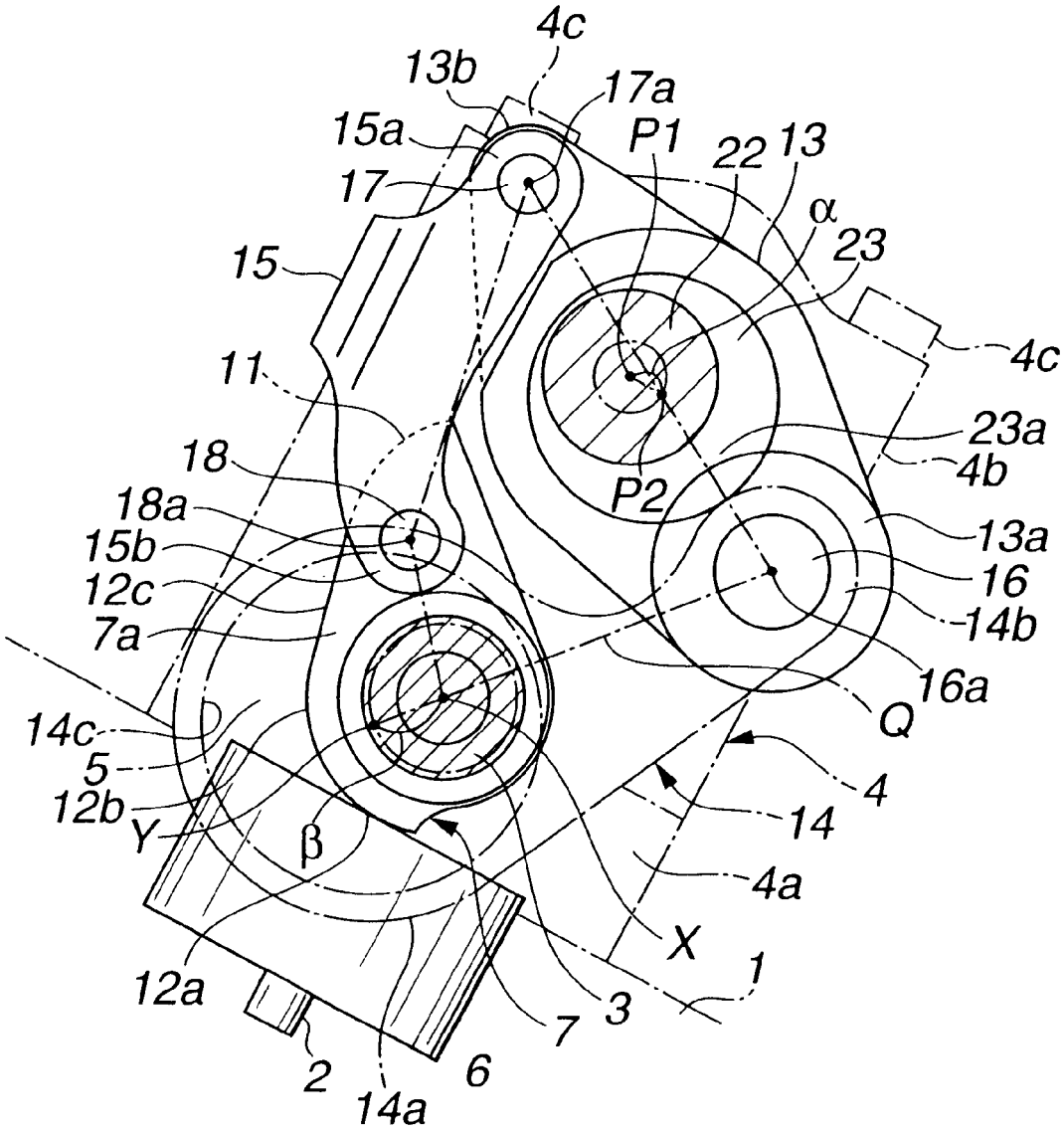
FIG. 4 is a schematic view showing an intake valve in the zero lift state during minimum valve-lift control.

Referring to FIGS. 1 and 4, in the first embodiment, the VVA apparatus comprises a pair of intake valves 2 slidably mounted to a cylinder head 1 through a valve guide, not shown, and biased in the closed direction by the force of a valve spring, a hollow driving shaft 3 rotatably supported by a bearing 4 in an upper portion of cylinder head 1, a crank or eccentric rotating cam 5 fixed to driving shaft 3, a VO cam 7 swingably supported on the outer periphery of driving shaft 3 and coming in slide contact with top faces 6*a* of valve lifters 6 disposed at the upper ends of intake valves 2, a transmission mechanism 8 interposed between crank cam 5 and VO cam 7 for transmitting torque of crank cam 5 to VO cam 7 as a rocking force, and a control mechanism 9 for controlling the operating position of transmission mechanism 8. Driving shaft 3, crank cam 5, VO cam 7, and transmission mechanism 8 constitute the alteration mechanism.

Driving shaft 3 extends in the engine longitudinal direction, and has one end with a follower sprocket, a timing chain wound thereon, etc., not shown, through which driving shaft 3 receives torque from an engine crankshaft. Driving shaft 3 is constructed to rotate counterclockwise as viewed in FIG. 1. Driving shaft 3 is formed out of a material of high strength.

Bearing 4 comprises a main bracket 4*a* arranged at the upper end of cylinder head 1 for supporting an upper portion of driving shaft 3, and an auxiliary bracket 4*b* arranged at the upper end of main bracket 4*a* for rotatably supporting a control shaft or rod 22 as will be described later. Brackets 4*a*, 4*b* are fastened together from above by a pair of bolts 4*c*.

As shown in FIGS. 1 and 4, crank cam 5 is roughly annularly formed out of a wear resistant material, and comprises a cylindrical portion 5*a* integrated with its outer end. A though hole is axially formed through crank cam 5 to receive driving shaft 3. A center Y of crank cam 5 is radially offset with respect to an axis X of driving shaft 3 by a predetermined amount β as shown in FIG. 4. Crank cam 5 is coupled with driving shaft 3 by a connecting pin, not shown, arranged diametrally through cylindrical portion 5*a* and driving shaft 3. Crank cam 5 is constructed to rotate clockwise or in the direction of arrows as viewed in FIG. 1 with rotation of driving shaft 3.

Valve lifters 6 are formed like a covered cylinder, each being slidably held in a hole of the cylinder head 1 and having a flat top face 6*a* with which a main body 7*a* of VO cam 7 comes in slide contact.

Figure 2:
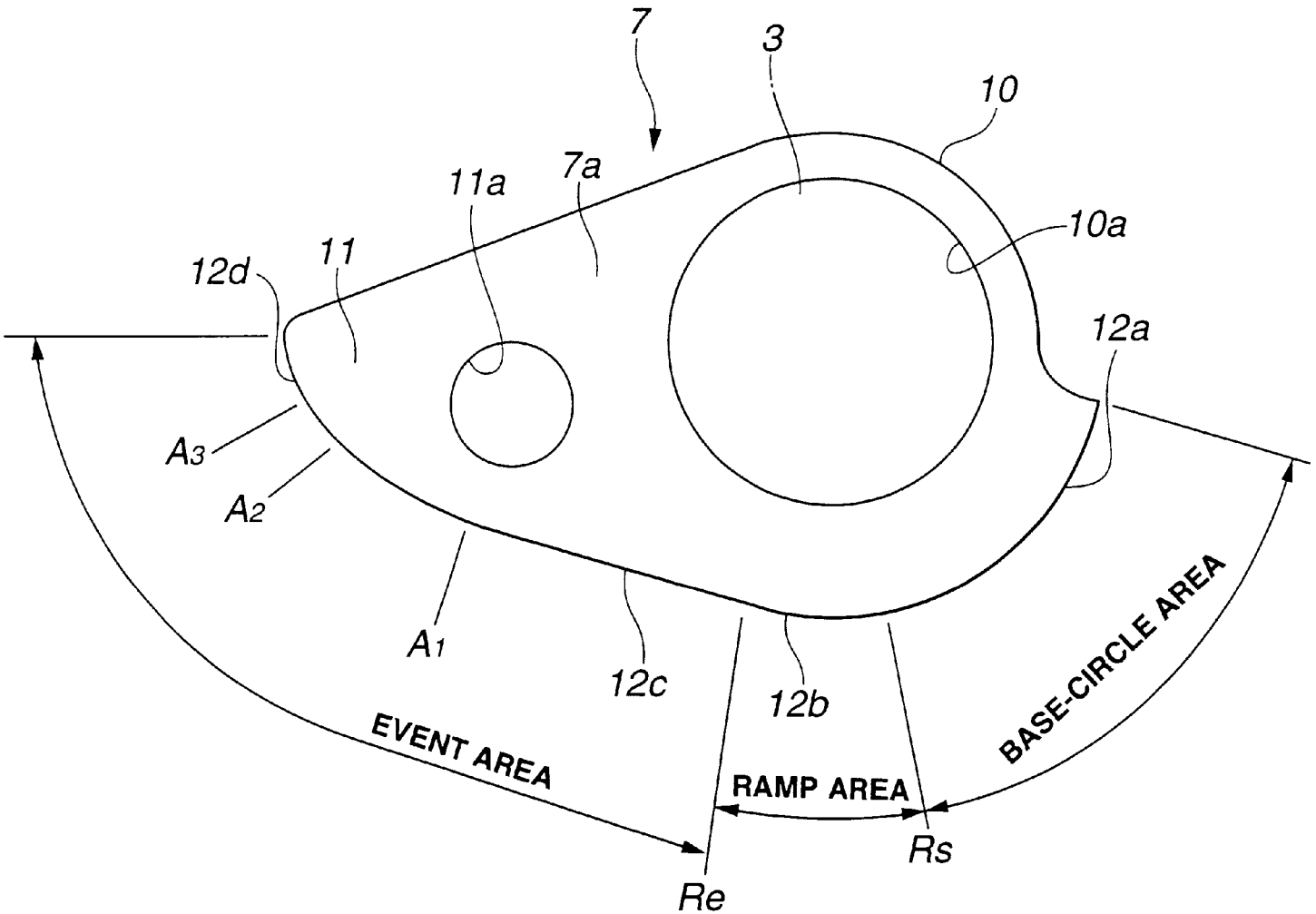
FIG. 2 is a side view showing a main body of a valve-operating (VO) cam.

Referring particularly to FIGS. 1–2, VO cam 7 comprises a pair of main bodies 7*a* shaped roughly like a raindrop and integrated with both ends of a roughly cylindrical base end 10. VO cam 7 has a support hole 10*a* formed axially through base end 10, through which driving shaft 3 is arranged to swingably support VO cam 7 in its entirety. VO cam 7 also has a pinhole 11 a formed through a cam nose 11 arranged at its one end. A lower face of cam main body 7*a* is formed with a cam face including a base-circle face 12*a* on the side of base end 10, a ramp face 12*b* circularly continuously extending from base-circle face 12*a* to cam nose 11, and a lift face 12*c* extending from ramp face 12*b* to top face 12*d* with the maximum lift arranged at a tip of cam nose 11. Base-circle face 12*a*, ramp face 12*b*, lift face 12*c*, and top face 12*d* come in contact with respective predetermined points of top face 6*a* of valve lifter 6 in accordance with the rocking position of VO cam 7, achieving a change in valve-lift characteristics.

Specifically, a predetermined angular range of base-circle face 12*a* corresponds to a base-circle area, and a predetermined angular range of ramp face 12*b* subsequent to the base-circle area corresponds to a ramp area, and a predetermined angular range of ramp face 12*b* from the ramp area to top face 12*d* corresponds to a lift or event area.

Transmission mechanism 8 comprises a rocker arm 13 disposed above driving shaft 3, a crank arm 14 for linking one end or first arm 13*a* of rocker arm 13 with crank cam 5, and a link member 15 for linking another end or second arm 13*b* of rocker arm 13 with VO cam 7.

As shown in FIGS. 1 and 4, a centrally located cylindrical base 13*c* of rocker arm 13 is rotatably supported by a control cam 23 as will be described later through a support hole 13*d*. A pinhole 16*a* for a pin 16 is formed through first arm 13*a* protruding from an outer side of one end of base 13*c*, whereas a pinhole for a pin 17 is formed through second arm 13*b* protruding from an outer side of another end of base 13*c*.

Crank arm 14 includes one end or relatively large-diameter annular base end 14*a* and another end or extension 14*b* arranged in a predetermined position of the outer peripheral surface of base end 14*a*. An engagement hole 14*c* is formed in the center of base end 14*a* for rotatably receiving the outer peripheral face of crank cam 5, whereas a pinhole is formed through extension 14*b* for rotatably receiving pin 16. An axis of pin 16 forms a pivotal point for extension 14*b* and first arm 13*a* of rocker arm 13.

As shown in FIGS. 1 and 4, link member 15 is formed roughly like letter L in cross section, and has bifurcated first and second ends 15*a*, 15*b*. WVth ends 15*a*, 15*b* holding second arm 13*b* of rocker arm 13 and cam nose 11 of cam main body 7*a*, link member 15 is rotatably connected to second arm 13*b* and cam nose 11 by pins 17, 18, respectively.

Arranged at respective one ends of pins 17, 18 are snap rings, not shown, for restricting axial movement of link member 15. Axes 17*a*, 18*a* of pins 17, 18 form pivotal points for first end 15*a* of link member 15 and second arm 13*b* of rocker arm 13, and second end 15*b* and cam nose 11 of VO cam 7, respectively.

Control mechanism 9 comprises control shaft 22 disposed above driving shaft 3 and rotatably supported on bearing 4, control cam 23 fixed at the outer periphery of control shaft 22 to form a rocking fulcrum of rocker arm 13, a DC motor or electric actuator 26 for controlling rotation of control shaft 22 through a ball-screw mechanism 24 and a gear mechanism 25, and an electronic control unit (ECU) 27 for controlling drive of DC motor 26.

As shown in FIG. 1, control shaft 22 is disposed parallel to driving shaft 3 to extend in the engine longitudinal direction. Control cam 23 is of the cylindrical shape, an axis P2 of which is offset from an axis P1 of control shaft 22 by an amount of a thick portion 23*a* or an amount a as shown in FIG. 4.

As shown in FIG. 1, ball-screw mechanism 24 comprises a pair of levers 29*a*, 29*b* protruding from a cylinder 29 fixed to one end of control shaft 22, a cylindrical nut member 31 disposed between the tips of levers 29*a*, 29*b* to be axially perpendicular to control shaft 22 and rotatable through a pin 30, and a threaded shaft 32 meshed with a female thread formed in the inner peripheral face of nut member 31.

Gear mechanism 25 comprises two bevel gears 25*a*, 25*b* connected to a tip of driving shaft 26*a* of DC motor 26 and a tip of threaded shaft 32, respectively, and having teeth portions axially perpendicularly meshed with each other.

ECU 27 serves to compute actual engine operating conditions in accordance with detection signals out of various sensors such as crank-angle sensor, airflow meter, coolant-temperature sensor and throttle-opening sensor. Moreover, ECU 27 provides a control signal to DC motor 26 in accordance with a detection signal out of a potentiometer 28 for detecting the rotating position of control shaft 22.

Figure 9:
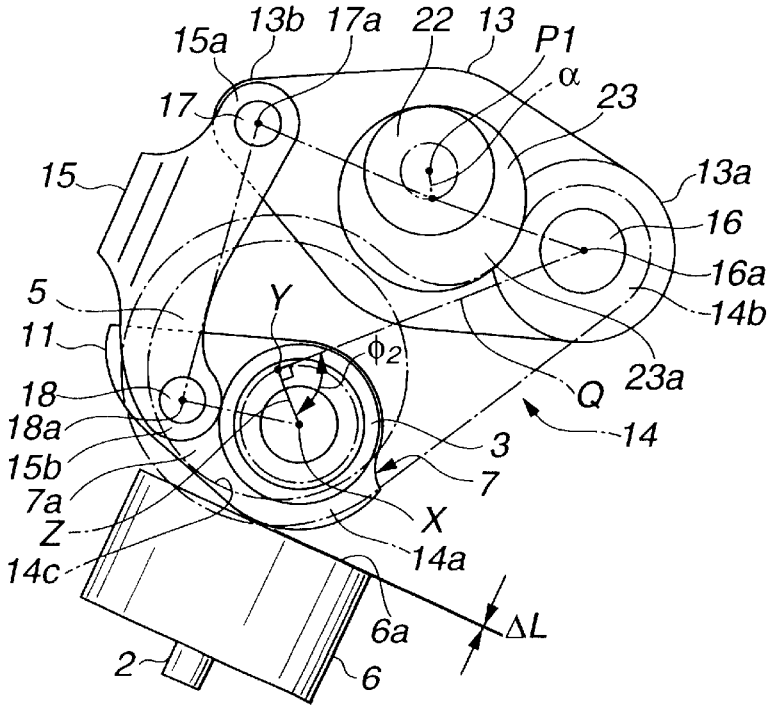
FIG. 9 is a view similar to FIG. 8, showing the intake valve in the up-ramp lift state during medium valve-lift control.

The whole of transmission mechanism 8 and VO cam 7 with control shaft 22 and control cam 23 as the center is configured in a singular way in accordance with the valve-lift characteristics. Specifically, when the valve-lift characteristics of intake valves 2 are controlled by the alteration mechanism to achieve a medium lift as shown in FIG. 9, an angle formed by a line Z connecting axis X of driving shaft 3 and axis Y of crank cam 5 and a line Q connecting axis Y of crank cam 5 and axis 16*a* of pin 16 at extension 14*b* of crank arm 14 is established to be roughly 90° while ramp face 12*b* of VO cam 7 is in slide contact with top face 6*a* of valve lifter 6.

Next, operation of the first embodiment will be described. When the engine is at low velocity and low load, DC motor 26 is rotated through gear mechanism 25 and ball-screw mechanism 24 in accordance with a control signal out of ECU 27, which drives control shaft 22 maximally counterclockwise (i.e. to a position shown in FIG. 4). Thus, referring to FIGS. 4–7, axis P2 of control cam 23 is moved to a rotation-angle position located in the lower-right direction of axis P1 of control shaft 22. That is, thick portion 23*a* of control cam 23 is moved from the side of driving shaft 3 to the side of pivotal point 16*a*. As a result, rocker arm 13 is moved counterclockwise in its entirety from the state shown in FIG. 12 to the state shown in FIG. 4. Thus, cam main body 7*a*, having cam nose 11 forcibly pulled upward through link member 15, is rotated clockwise in its entirety.

Therefore, referring to FIGS. 4–7, when crank cam 5 is rotated during opening/closing operation of intake valve 2 to press first arm 13*a* of rocker arm 13 upward through crank arm 14, a corresponding lift is transmitted to VO cam 7 and valve lifter 6 through link member 15, which is sufficiently small.

Figure 3A:
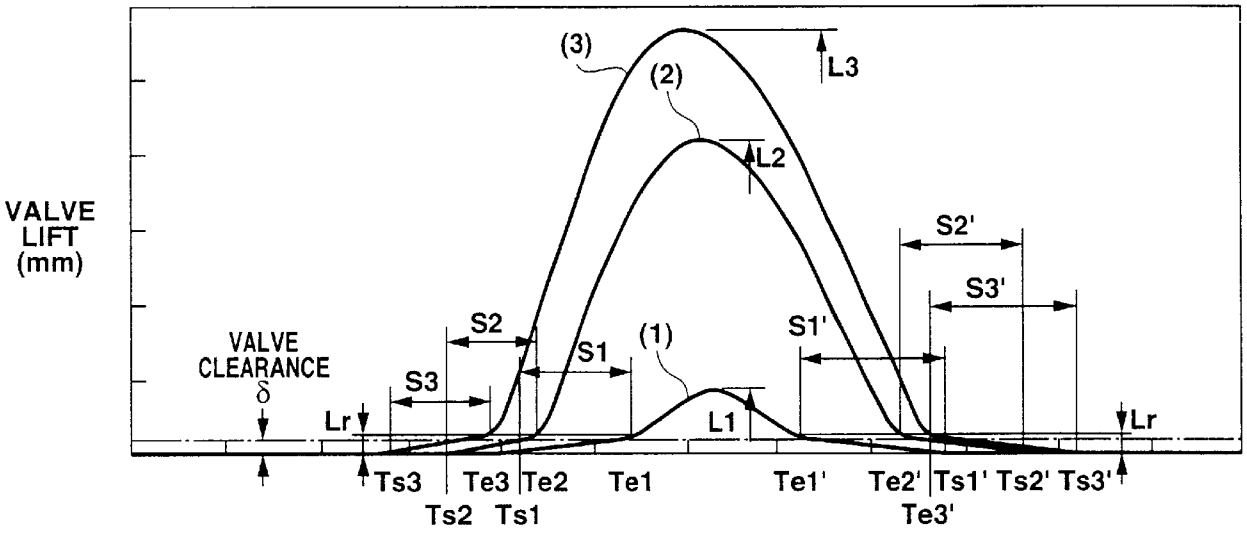
FIG. 3A is a graphical representation illustrating valve-lift characteristics of the VO cam.

Thus, in such low-velocity low-load range, referring to FIG. 3A, the lift amount of intake valve 2 has a sufficiently small value L1 as shown by a curve (1) in FIG. 3A, obtaining lowered friction. Moreover, the opening timing of intake valve 2 is delayed to decrease overlap with an exhaust valve, resulting in improved fuel consumption and stable engine rotation.

Referring to FIGS. 4–7, a concrete description will be made with regard to actuation of the alteration mechanism and the valve-lift characteristics obtained by the cam face of VO cam 7 during minimum valve-lift control.

Referring to FIG. 4, there is shown VO cam 7 in the minimum rock state wherein center Y of crank cam 5 is located opposite to pivotal point 16*a* with respect to axis X of driving shaft 3, so that pivotal point 16*a* is pulled upward through crank arm 14. Thus, rocker arm 13 is rotated clockwise to bounce thereby link member 15, which in turn bounces VO cam 7 to be in the minimum rock position. Then, base-circle face 12*a* of VO cam 7 is in contact with valve lifter 6, providing zero lift of intake valve 2 as shown in FIGS. 3A (see curve (1)) and 4.

Figure 5:
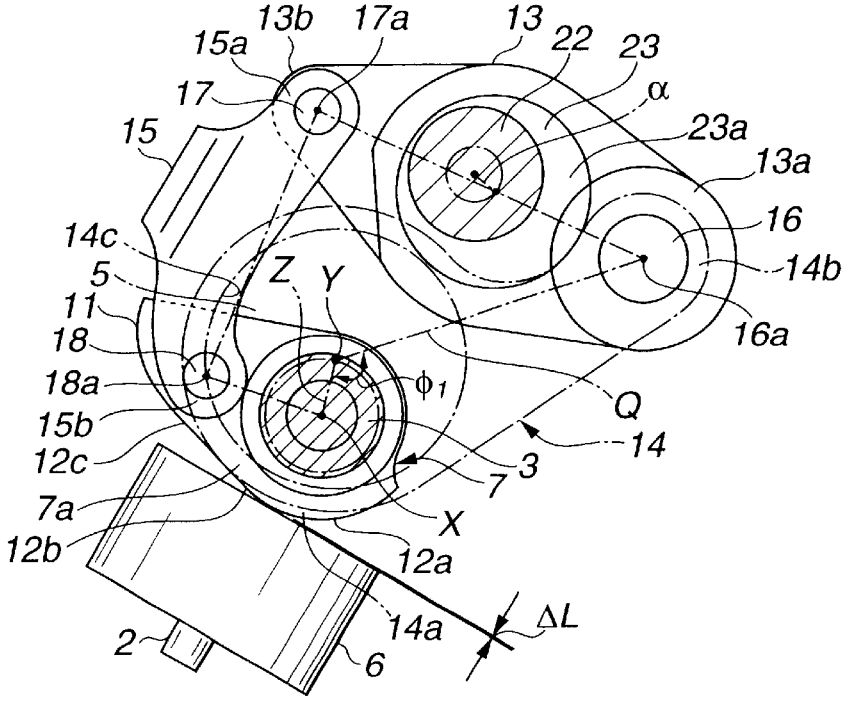
FIG. 5 is a view similar to FIG. 4, showing the intake valve in the up-ramp lift state during minimum valve-lift control.

In this state, when driving shaft 3 is rotated clockwise, center Y of crank cam 5 is rotated in the same direction as shown in FIG. 5 to press crank arm 14 upward. Thus, rocker arm 13 is rotated counterclockwise to rotate VO cam 7 in the same direction or counterclockwise through link member 15. As a result, the contacting cam-face portion moves to ramp face 12*b* to start up-ramp lift wherein top face 6*a* of valve lifter 6 comes in contact with any point of the ramp area Rs-Re shown in FIG. 2. Therefore, a valve lift amount ΔL in this area is smaller than a ramp-lift height Lr at Re, but greater than zero as shown in FIG. 3A.

An angle $\phi 1$ of ∠XY16*a* shown in FIG. 5 is greater than 90°. Thus, when center Y of crank cam 5 is rotated in synchronism with driving shaft 3 at the same angular velocity, the angular velocity of rotation of rocker arm 13 is smaller than that when angle $\phi 1$ is 90°, i.e. during control of a medium lift L2 shown in FIGS. 8–11 as will be described later. This results in smaller angular velocity of rotation of VO cam 7, and longer period where top face 6*a* of valve lifter 6 is in contact with ramp area Rs-Re shown in FIG. 2, i.e. greater angle of rotation of driving shaft 3.

The reason why angle $\phi 1$ is greater than 90° is that pivotal point 16*a* is moved upward since axis P2 of control cam 23 is distant from axis X of driving shaft 3.

Figure 6:
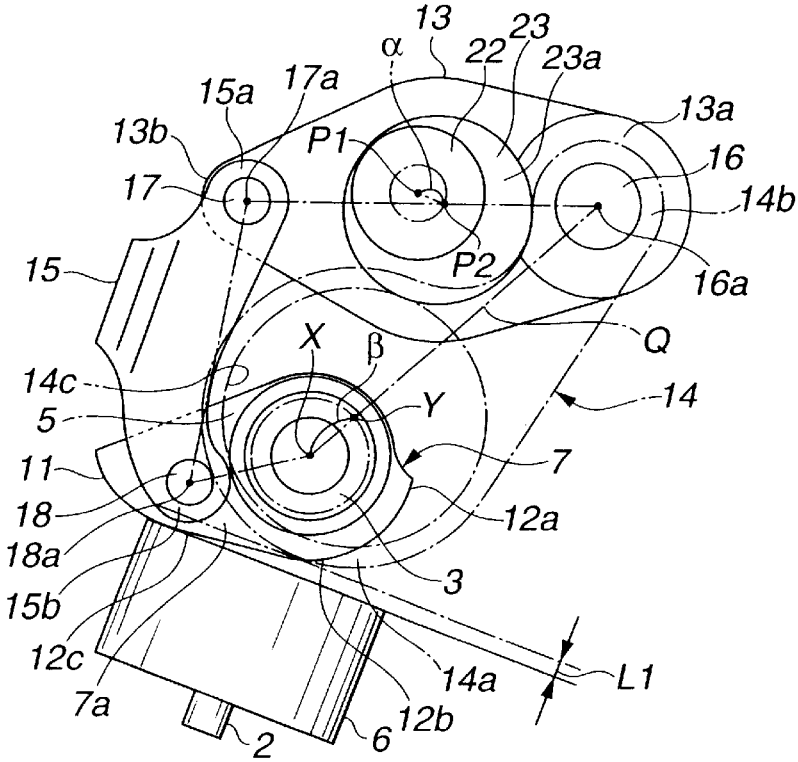
FIG. 6 is a view similar to FIG. 5, showing the intake valve in the maximum lift state during minimum valve-lift control.

Then, referring to FIG. 6, when driving shaft 3 is further rotated clockwise to have center Y of crank cam 5 on a line connecting axis X of driving shaft 3 and pivotal point 16*a*, pivotal point 16*a* is raised maximally, and rocker arm 13 is rotated maximally counterclockwise, obtaining VO cam 7 rocked maximally. This results in a peak lift amount corresponding to minimum lift L1 as described above. Thus, a contact position of the cam face of VO cam 7 with respect to valve lifter 6 is moved leftward from position Re shown in FIG. 2 to enter the event area at a point A1, providing peak lift L1.

Figure 7:
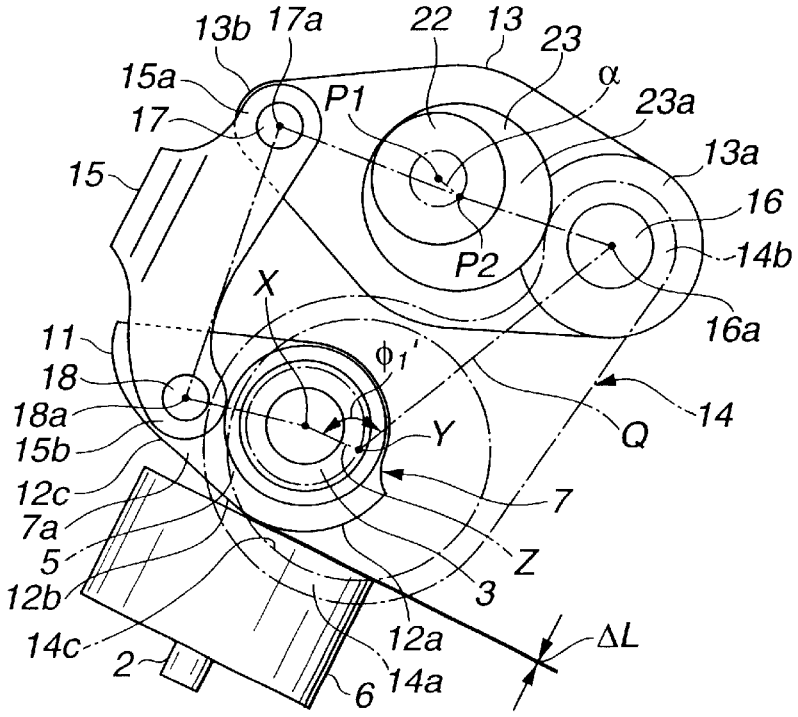
FIG. 7 is a view similar to FIG. 6, showing the intake valve in the down-ramp lift state during minimum valve-lift control.

Referring to FIG. 7, with driving shaft 3 rotated further, VO cam 7 comes in contact with valve lifter 6 again in ramp area Rs-Re (down ramp), so that the valve lift amount is decreased to have ΔL again (Lr>ΔL>0).

Figure 13:
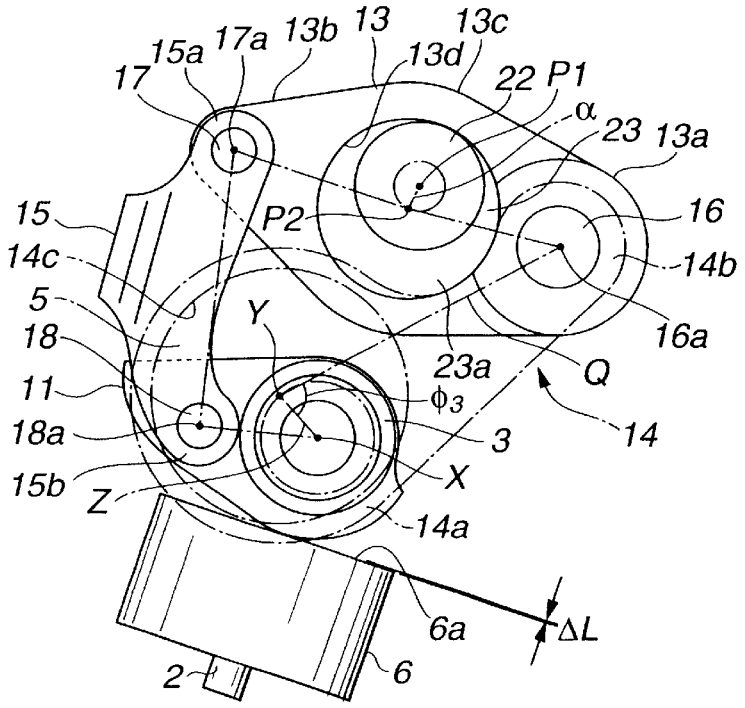
FIG. 13 is a view similar to FIG. 12, showing the intake valve in the up-ramp lift state during maximum valve-lift control.
Figure 15:
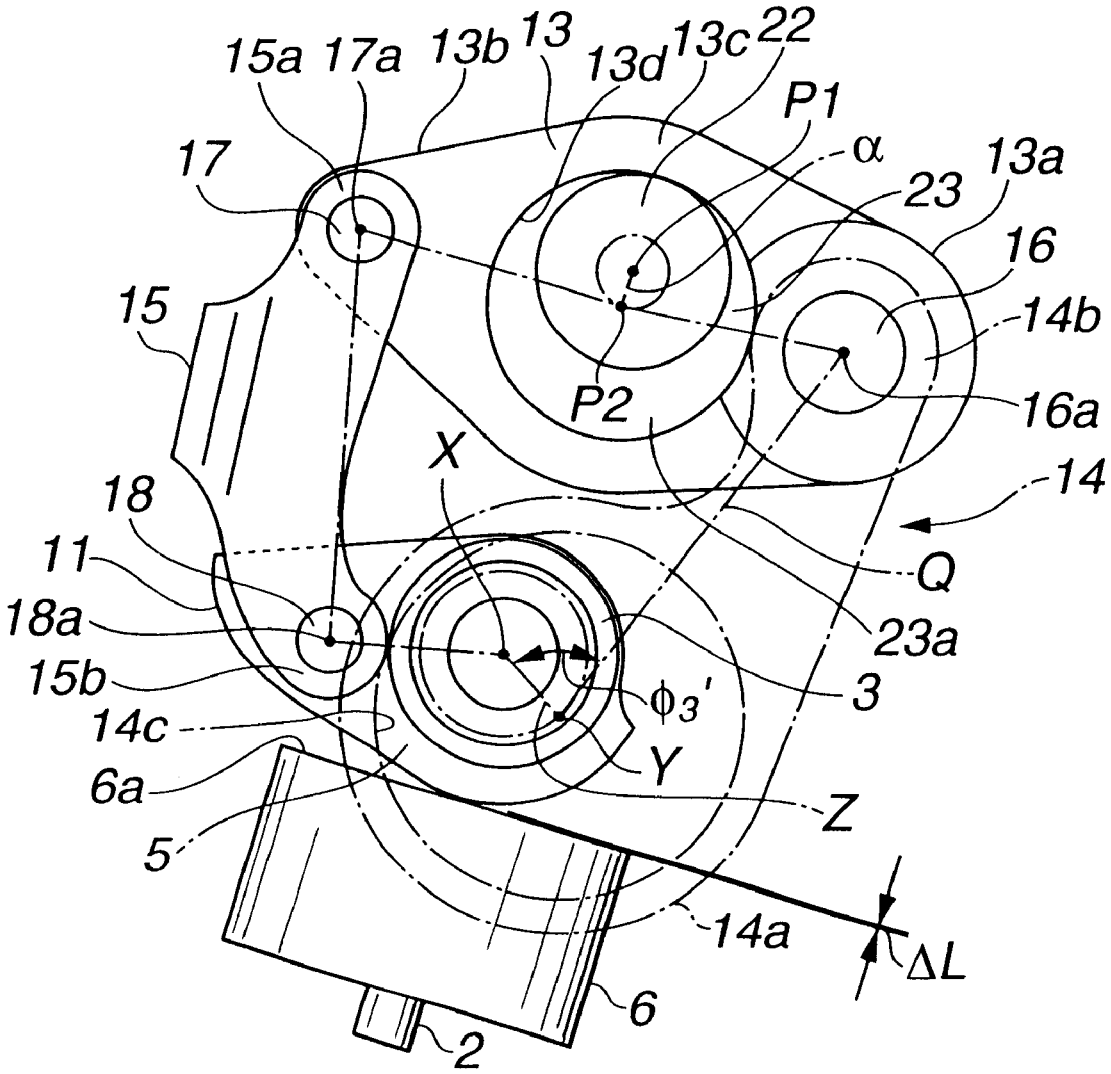
FIG. 15 is a view similar to FIG. 14, showing the intake valve in the down-ramp lift state during maximum valve-lift control.

An angle $\phi 1$ of ∠XY16*a* shown in FIG. 7 has a value equal to angle $\phi 1$. Referring to FIGS. 13 and 15, an angle $\phi 3$ is equal to an angle $\phi 3$ for the same reason as that described above. As the valve lift amounts have the same value ΔL, VO cams 7 occupy the same position, and thus rocker arms 13 occupy the same position, resulting in pivotal points 16*a* occupied in the same position. The reason is that a triangle X-Y-16*a* in FIG. 13 showing the up-ramp position and a triangle X-Y-16*a* in FIG. 15 showing the down-ramp position are geometrically symmetric with respect to a segment X-16*a*.

Thus, when center Y of crank cam 5 is rotated in synchronism with driving shaft 3 at the same angular velocity, the angular velocity of rotation of rocker arm 13 is smaller since angle $\phi 1'$ differs from 90°. This results in smaller angular velocity of rotation of VO cam 7, and longer down-ramp period where valve lifter 6 is in contact with ramp area Rs-Re shown in FIG. 2, i.e. greater angle of rotation of driving shaft 3.

Figure 3B:
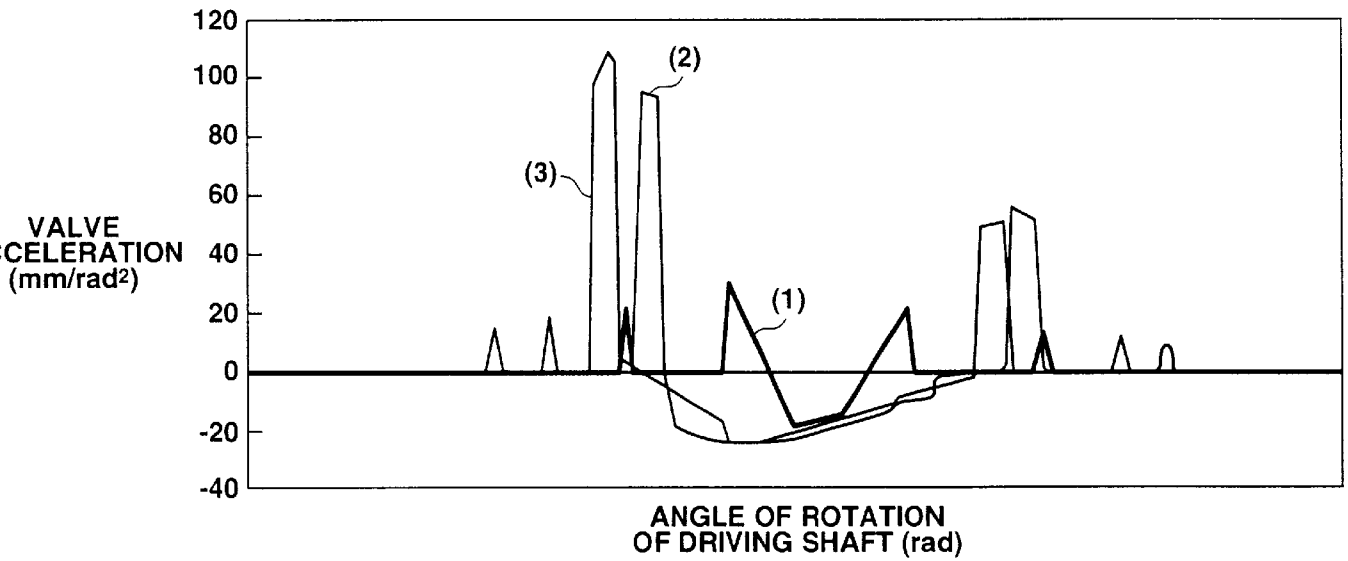
FIG. 3B is a view similar to FIG. 3A, illustrating valve-acceleration characteristics of the VO cam at respective valve lifts.

Referring to FIG. 3B, a curve (1) shows valve acceleration. As shown in FIG. 3A, the up-ramp period is a period S1 between a lift starting point Ts1 and a positive acceleration starting point Te1. Ts1 corresponds to an instant of contacting the cam face of VO cam 7 at position Rs, whereas Te1 corresponds to an instant of contacting the cam face at position Re.

The down-ramp period is a period S1' between a positive acceleration terminating point Te1' and a lift terminating point Ts1'. Ts1' corresponds to an instant of contacting the cam face of VO cam 7 at position Rs, whereas Te1' corresponds to an instant of contacting the cam face at position Re.

Actual valve-lift characteristics are obtained by subtracting a valve clearance δ defined between valve lifter 6 and VO cam 7 from the valve lift.

On the other hand, when the engine operating conditions passes from the low-velocity low-load range to the medium-velocity high-load range, for example, DC motor 26 is rotated in the reverse direction in accordance with a control signal out of ECU 27, rotating clockwise control shaft 22 by a predetermined amount through gear mechanism 25 and ball-screw mechanism 24.

Thus, referring to FIGS. 8–11, control cam 23 is controlled such that axis P2 is held at a rotation-angle position located below axis P1 of control shaft 22 by a predetermined amount, and thick portion 23*a* is moved to slightly separate from pivotal point 16*a*. This moves rocker arm 13 in its entirety counterclockwise with respect to the position shown in FIG. 4. As a result, cam main body 7*a*, having cam nose 11 forcibly pressed downward through link member 15, is rotated slightly counterclockwise in its entirety.

Therefore, as shown in FIGS. 8–11, when crank cam 5 is rotated during opening/closing operation of intake valve 2 to press first arm 13*a* of rocker arm 13 upward through crank arm 14, a corresponding lift is transmitted to VO cam 7 and valve lifter 6 through link member 15, which is larger than the minimum lift.

Thus, in such medium-velocity high-load range, referring to FIG. 3A, the lift amount of intake valve 2 has a medium value L2 as shown by a curve (2) in FIG. 3A, obtaining lowered friction.

Referring to FIGS. 8–11, a concrete description will be made with regard to actuation of the alteration mechanism and valve-lift characteristics obtained by the cam face of VO cam 7 during medium valve-lift control.

Figure 8:
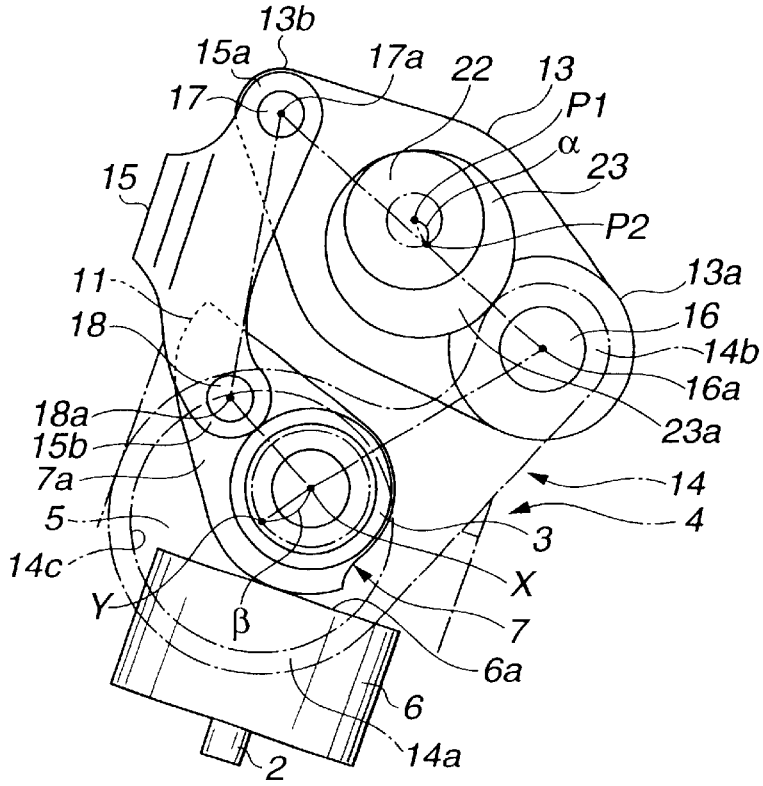
FIG. 8 is a view similar to FIG. 7, showing the intake valve in the zero lift state during medium valve-lift control.

Referring to FIG. 8, there is shown VO cam 7 in the minimum rock state wherein center Y of crank cam 5 is located opposite to pivotal point 16*a* with respect to axis X of driving shaft 3, so that pivotal point 16*a* is pulled downward through crank arm 14. Thus, rocker arm 13 is rotated clockwise to bounce thereby link member 15, which in turn bounces VO cam 7 to be in the minimum rock position. Then, base-circle face 12*a* of VO cam 7 is in contact with valve lifter 6, providing zero lift of intake valve 2 as shown in FIGS. 3A (see curve (2)) and 8.

In this state, when driving haft 3 is rotated clockwise, center Y of crank cam 5 is rotated in the same direction as shown in FIG. 9 to press crank arm 14 upward. Thus, rocker arm 13 is rotated counterclockwise to rotate VO cam 7 in the same direction or counterclockwise through link member 15. As a result, the contacting cam-face portion moves to ramp face 12*d* to start up-ramp lift wherein top face 6*a* of valve lifter 6 comes in contact with any point of the ramp area Rs-Re shown in FIG. 2. Therefore, valve lift amount ΔL in this area is smaller than ramp-lift height Lr at Re, but greater than zero as shown in FIG. 3A.

An angle φ2 of ∠XY16*a* shown in FIG. 9 is 90°. Thus, when center Y of crank cam 5 is rotated in synchronism with driving shaft 3 at the same angular velocity, the angular velocity of rotation of rocker arm 13 is smaller than that when angle φ2 differs from 90°. The reason is that the velocity direction of center Y forms 90° with respect to line Z or the XY direction, and corresponds to line Q connecting center Y and pivotal point 16*a*, so that crank arm 14 is pressed upward at the moving speed of center Y as-is, achieving rotation of rocker arm 13 at higher angular velocity.

This results in greater angular velocity of rotation of VO cam 7, and shorter period where top face 6*a* of valve lifter 6 is in contact with ramp area Rs-Re shown in FIG. 2, i.e. smaller angle of rotation of driving shaft 3.

The reason why angle φ2, roughly 90°, is smaller than φ1 in the above-mentioned minimum-lift phase of control shaft 22 is that pivotal point 16*a* is moved downward since axis P2 of control cam 23 is close to axis X of driving shaft 3.

Figure 10:
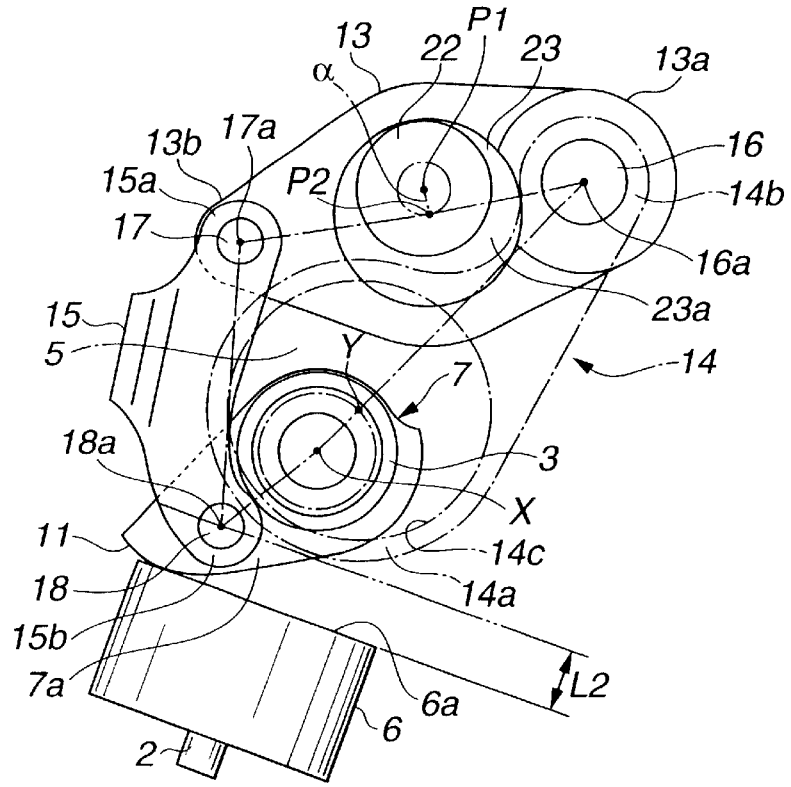
FIG. 10 is a view similar to FIG. 9, showing the intake valve in the maximum lift state during medium valve-lift control.

Then, referring to FIG. 10, when driving shaft 3 is further rotated clockwise to have center Y of crank cam 5 on line connecting axis X of driving shaft 3 and pivotal point 16*a*, pivotal point 16*a* is raised maximally, and rocker arm 13 is rotated maximally counterclockwise, obtaining VO cam 7 rocked maximally. This results in a peak lift amount corresponding to medium lift L2 greater than minimum lift L1. Thus, a contact position of the cam face of VO cam 7 with respect to valve lifter 6 is moved leftward from position Re shown in FIG. 2 to enter in the event area at a point A2, providing peak lift L2.

Figure 11:
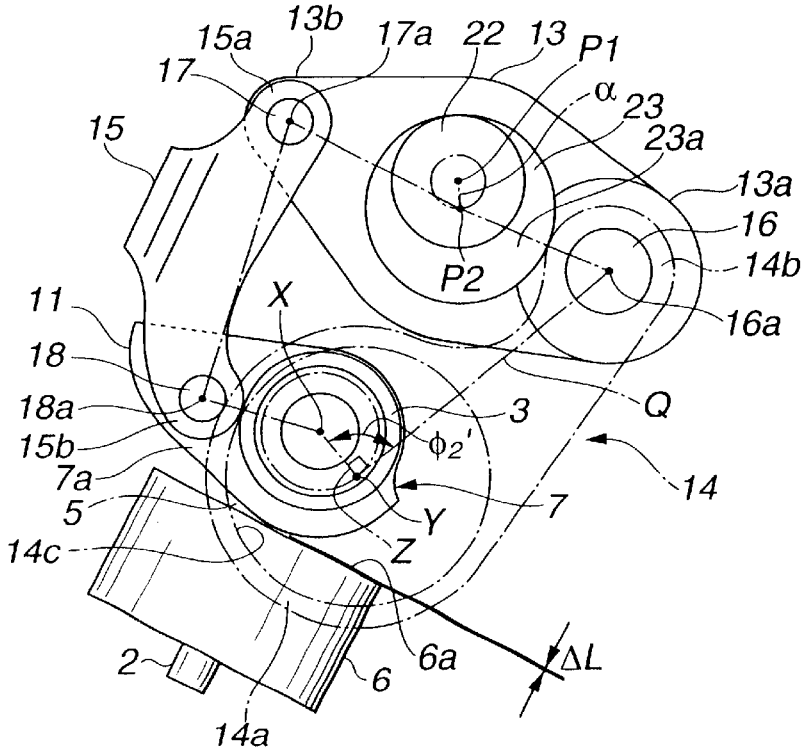
FIG. 11 is a view similar to FIG. 10, showing the intake valve in the down-ramp lift state during medium valve-lift control.

Referring to FIG. 11, with driving shaft 3 rotated further, VO cam 7 comes in contact with valve lifter 6 again in ramp area Rs-Re (down ramp), so that the valve lift amount is decreased to have ΔL again (Lr>ΔL>0).

An angle φ2 of ∠XY16*a* shown in FIG. 11 has a value equal to angle φ2 or 90° for the reason described above. Thus, when center Y of crank cam 5 is rotated in synchronism with driving shaft 3 at the same angular velocity, the angular velocity of rotation of rocker arm 13 is greater since angle φ2 is 90°. This results in greater angular velocity of rotation of VO cam 7, and shorter down-ramp period where valve lifter 6 is in contact with ramp area Rs-Re shown in FIG. 2, i.e. smaller angle of rotation of driving shaft 3.

Referring to FIG. 3B, a curve (2) shows valve acceleration. As shown in FIG. 3A, the up-ramp period is a period S2 between a lift starting point Ts2 and a positive acceleration starting point Te2. Ts2 corresponds to an instant of contacting the cam face of VO cam 7 at position Rs, whereas Te2 corresponds to an instant of contacting the cam face at position Re.

The down-ramp period is a period S2' between a positive acceleration terminating point Te2 and a lift terminating point Ts2. Ts2 corresponds to an instant of contacting the cam face of VO cam 7 at position Rs, whereas Te2 corresponds to an instant of contacting the cam face at position Re.

Figure 12:
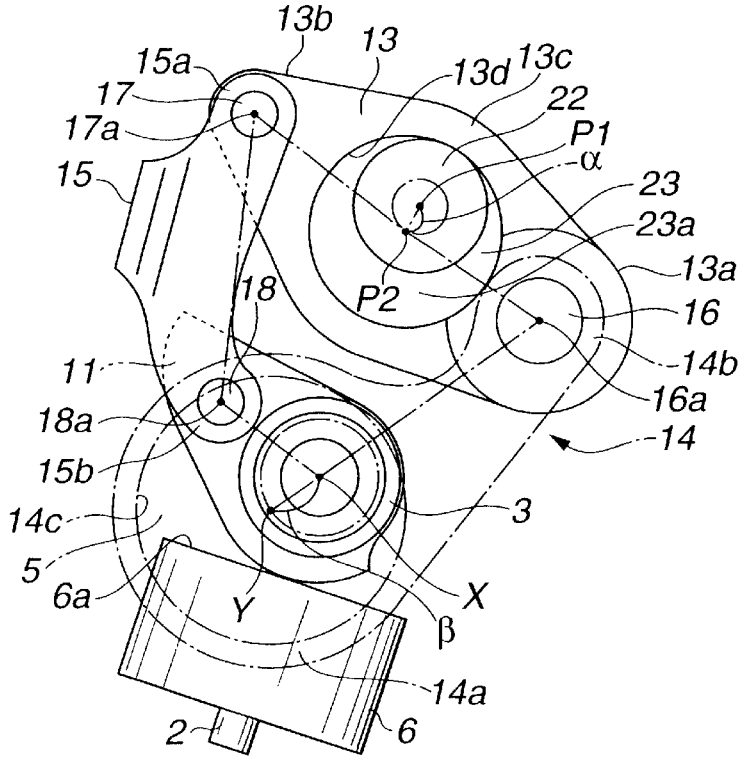
FIG. 12 is a view similar to FIG. 11, showing the intake valve in the zero lift state during maximum valve-lift control.

When the engine operating conditions passes from the medium-velocity high-load range to the high-velocity high-load range, DC motor 26 is rotated further in the reverse direction, rotating maximally clockwise control shaft 22 to the position shown in FIG. 12 through gear mechanism 25 and ball-screw mechanism 24.

Thus, referring to FIGS. 12–15, control cam 23 is controlled such that axis P2 is further rotated from axis P1 of control shaft 22 and held at a rotation-angle position located leftward below axis P1, and thick portion 23*a* is moved to largely separate from driving shaft 3 and pivotal point 16*a*. This moves rocker arm 13 in its entirety further counterclockwise from the position shown in FIG. 8 to the position shown in FIG. 12. As a result, cam main body 7*a*, having cam nose 11 forcibly pressed downward through link member 15, is rotated largely counterclockwise in its entirety.

Therefore, as shown in FIGS. 11–15, a contact position of the cam face of cam main body 7*a* with respect to top face 6*a* of valve lifter 6 is moved leftward or to the side of lift face 12*c*. This rotates crank cam 5 as shown in FIG. 13 to press first arm 13*a* of rocker arm 13 upward through crank arm 14, providing a large lift L3 with respect to valve lifter 6 as shown in FIG. 3A.

Thus, in such high-velocity high-load range, referring to FIG. 3A, the valve-lift characteristics are greater than those in the low-velocity low-load range and in the medium-velocity high-load range, providing large lift L3 as shown by a curve (3) in FIG. 3A, resulting in advanced opening timing and delayed closing timing of intake valves 2. This leads to enhancement of intake charging efficiency and thus achieving of sufficient output.

Referring to FIGS. 12–15, a concrete description will be made with regard to actuation of the alteration mechanism and valve-lift characteristics obtained by the cam face of VO cam 7 during large valve-lift control.

Referring to FIG. 12, there is shown VO cam 7 in the minimum rock state wherein center Y of crank cam 5 is located opposite to pivotal point 16*a* with respect to axis X of driving shaft 3, so that pivotal point 16*a* is pulled downward through crank arm 14. Thus, rocker arm 13 is rotated clockwise to bounce thereby link member 15, which in turn bounces VO cam 7 to be in the minimum rock position. Then, base-circle face 12*a* of VO cam 7 is in contact with valve lifter 6, providing zero lift of intake valve 2 as shown in FIGS. 3A (see curve (3)) and 12.

In this state, when driving haft 3 is rotated clockwise, center Y of crank cam 5 is rotated in the same direction as shown in FIG. 13 to press crank arm 14 upward. Thus, rocker arm 13 is rotated counterclockwise to rotate VO cam 7 in the same direction or counterclockwise through link member. 15. As a result, the contacting cam-face portion moves to ramp face 12*d* to start up-ramp lift wherein top face 6*a* of valve lifter 6 comes in contact with any point of the ramp area Rs-Re shown in FIG. 2. Therefore, valve lift amount ΔL in this area is smaller than ramp-lift height Lr at Re, but greater than zero as shown in FIG. 3A.

Angle ϕ3 of ∠XY16*a* shown in FIG. 9 is smaller than 90°. Thus, when center Y of crank cam 5 is rotated in synchronism with driving shaft 3 at the same angular velocity, the angular velocity of rotation of rocker arm 13 is smaller than that when angle ϕ3 is 90°. The reason is that the velocity direction of center Y forms 90° with respect to line Z or the XY direction, and corresponds to the 16*a*-Y direction of crank arm 14 or line Q when ϕ3 is 90°, so that crank arm 14 is pressed upward at the moving speed of center Y as-is, achieving rotation of rocker arm 13 at higher angular velocity. On the other hand, when ϕ3 differs from 90°, the velocity in the direction of pressing crank arm 14 upward is lowered to cause lowering of the angular velocity of rotation of rocker arm 13.

The angular velocity of rotation of rocker arm 13 is smaller than that when angle ϕ3 is 90°. This results in smaller angular velocity of rotation of VO cam 7, and shorter period where top face 6*a* of valve lifter 6 is in contact with ramp area Rs-Re shown in FIG. 2, i.e. smaller angle of rotation of driving shaft 3.

Figure 14:
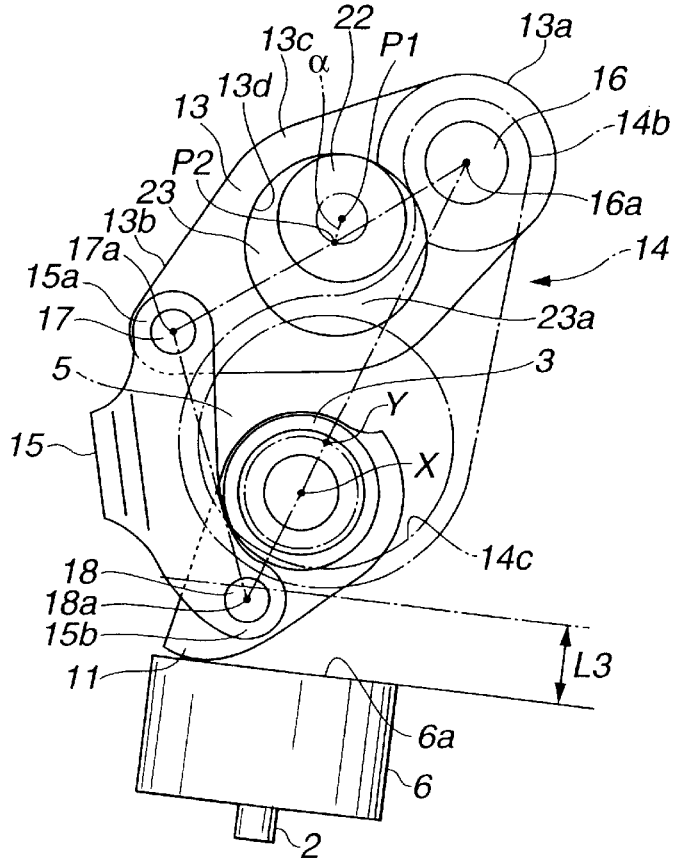
FIG. 14 is a view similar to FIG. 13, showing the intake valve in the maximum lift state during maximum valve-lift control.

Then, referring to FIG. 14, when driving shaft 3 is further rotated clockwise to have center Y of crank cam 5 on line connecting axis X of driving shaft 3 and pivotal point 16*a*, pivotal point 16*a* is raised maximally, and rocker arm 13 is rotated maximally counterclockwise, obtaining VO cam 7 rocked maximally. This results in a peak lift amount corresponding to large lift L3 greater than medium lift L2. Thus, a contact position of the cam face of VO cam 7 with respect to valve lifter 6 is moved leftward from position Re shown in FIG. 2 to enter in the event area at a point A3, providing peak lift L3.

Referring to FIG. 15, with driving shaft 3 rotated further, VO cam 7 comes in contact with valve lifter 6 again in ramp area Rs-Re (down ramp), so that the valve lift amount is decreased to have ΔL again (Lr>ΔL>0).

Angle ϕ3' of ∠XY16*a* shown in FIG. 15 has a value smaller than 90°. Thus, when center Y of crank cam 5 is rotated in synchronism with driving shaft 3 at the same angular velocity, the angular velocity of rotation of rocker arm 13 is smaller than that when angle ϕ3' is 90° for the same reason as that described above. This results in smaller angular velocity of rotation of VO cam 7, and longer down-ramp period where valve lifter 6 is in contact with ramp area Rs-Re shown in FIG. 2, i.e. greater angle of rotation of driving shaft 3.

Referring to FIG. 3B, a curve (3) shows valve acceleration. As shown in FIG. 3A, the up-ramp period is a period S3 between a lift starting point Ts3 and a positive acceleration starting point Te3. Ts3 corresponds to an instant of contacting the cam face of VO cam 7 at position Rs, whereas Te3 corresponds to an instant of contacting the cam face at position Re.

The down-ramp period is a period S3' between a positive acceleration terminating point Te3' and a lift terminating point Ts3'. Ts3' corresponds to an instant of contacting the cam face of VO cam 7 at position Rs, whereas Te3' corresponds to an instant of contacting the cam face at position Re.

In the first embodiment, at minimum lift L1, the up-ramp period and the down-ramp period are established to be longer as described above. This allows lowering of the up-ramp and down-ramp velocities, resulting in full reduction in impact noise such as lift starting noise or seating noise of intake valve 2 in the low-rotation low-load range including idle running. It is understood that valve-noise reduction can be obtained when adopting the alteration mechanism to the exhaust valves.

Moreover, at medium lift L2, the up-ramp period and the down-ramp period are established to be shorter, leading to enhanced engine performance such as intake and exhaust efficiency, torque achievement or the like in the medium-rotation high-load range wherein greater torque is required. Specifically, shortened down-ramp period or slightly lifting period on the valve lift of intake valve 2 allows restraint of re-discharge of intake gas from the cylinder. Moreover, shortened up-ramp period or slightly lifting period allows restraint of backflow of exhaust gas to an intake system. Thus, negative factors in terms of intake efficiency can be restrained such as re-discharge of intake gas from the cylinder and backflow of exhaust gas to the intake system, resulting in enhanced torque. Moreover, restrained negative factors can provide relatively increased medium lift L2, leading to improved charging efficiency and thus enhanced torque.

On the other hand, shortened up-ramp and down-ramp periods cause an increase in lift starting noise and seating noise of intake valve 2. However, in the medium-rotation high-load range, such noises are cancelled due to an increase in other noises such as drive noise of other mechanisms with increasing of engine rotation, combustion noise at high load, etc., presenting no particular problem.

Further, when adopting the alteration mechanism to the exhaust valves, the same effect can be obtained in the medium-rotation high-load range. Specifically, with exhaust valves, medium lift L2 is applied in the medium-rotation high-load range wherein greater torque is required, since a lift increase to a certain extent is necessary to discharge exhaust gas having increased amount due to high load for enhancement of the exhaust efficiency. Thus, the opening timing of the exhaust valves is advanced substantively to discharge combustion gas before fully releasing its energy. Moreover, with longer down-ramp period, the closing timing of the exhaust valves is delayed substantively to cause backflow of exhaust gas to the intake system. Therefore, on the exhaust side also, shortening the up-ramp and down-ramp periods in this operating range can restrain occurrence of such negative factors in terms of the exhaust efficiency, resulting in enhanced torque.

Further, in the first embodiment, at maximum lift L3, the up-ramp period and the down-ramp period are established to be longer as described above. This allows lowering of the up-ramp velocity to achieve less occurrence of irregular motion of intake valve 2 at opening. This also allows lowering of the down-ramp velocity to achieve less occurrence of bounce of intake valve 2 at closing. That is, valve behavior is improved, resulting in improvement in the intake efficiency and thus the output, and in the durability of the alteration mechanism.

It is understood that the same effect can be obtained when adopting the features of the present invention to the exhaust valves. Specifically, in the high-rotation range, a larger quantity of exhaust gas should be discharged. And an influence of exhaust inertia becomes noticeable due to shorter absolute duration where the exhaust valve is open, so that the lift amount of the exhaust valve should largely be increased for enhancement of the output. Therefore, control is carried out with maximum lift L3. The up-ramp velocity is smaller to achieve less occurrence of irregular motion of the exhaust valve at opening. The down-ramp velocity is also smaller to achieve less occurrence of bounce of intake valve 2 at closing. This results in improvement in the output due to increased exhaust efficiency, and in the durability of the alteration mechanism.

Furthermore, in the first embodiment, ramp-lift height Lr is constant in principle, since Lr is determined by the ramp-lift height of VO cam 7. Specifically, in typical valve actuation systems with no hydraulic rush adjuster, in order to consider prevention of valve thrust, etc. due to thermal-expansion difference of parts of the valve actuation system, etc., a so-called valve clearance of less than ramp lift is defined between base-circle face 12*a* of VO cam 7 and top face 6*a* of valve lifter 6 when the engine valve is closed. In the first embodiment, the ramp lifts are of the same magnitude regardless of the valve lift amount, having an advantage of less occurrence of unexpected valve thrust at valve closing and with any valve lift amount.

Moreover, the alteration mechanism has a valve clearance which is constant regardless of the valve lift amount in principle, resulting in sure prevention of unexpected valve thrust regardless of the operating conditions.

Figure 16:
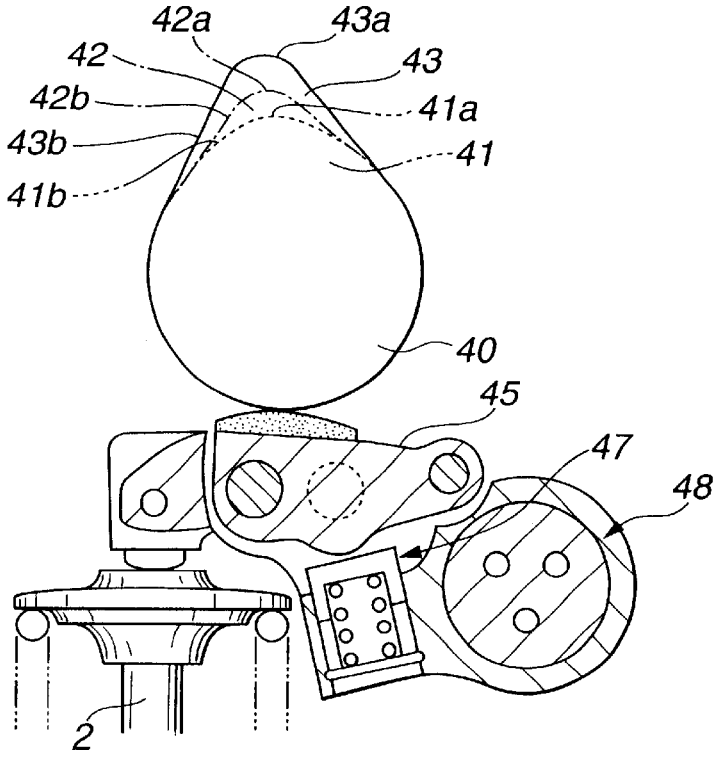
FIG. 16 is a sectional view taken along the line XVI—XVI in FIG. 17.
Figure 17:
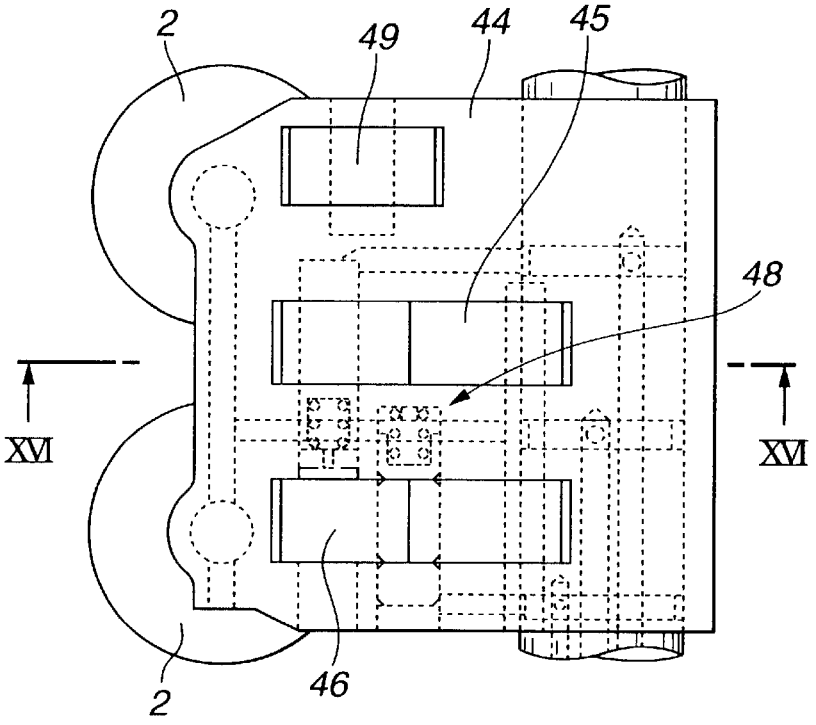
FIG. 17 is a plan view showing a second embodiment of the present invention.

FIGS. 16–17 show a second embodiment of the present invention which is substantially the same in structure as an arrangement disclosed in U.S. Pat. No. 5,085,182 issued Feb. 4, 1992 to Nakamura, et al., the entire contents of which are incorporated hereby by reference. In the second embodiment, a low-velocity cam 41, a medium-velocity cam 42, and a high-velocity cam 43 are disposed adjacent to each other and fixed to a camshaft 40 rotated in synchronism with a crankshaft. Also arranged are a main rocker arm 44 with which low-velocity cam 41 comes in slide contact and sub-rocker arms 45, 46 with which medium-velocity cam 42 and high-velocity cam 43 come in slide contact, respectively. In the low rotation range, sub-rocker arms 45, 46 are put in lost motion by a lost-motion mechanism 47. In the medium/high rotation range, they are coupled with main rocker arm 44 as required through a switching mechanism 48 to carry out switching of cams 41–43 with respect to intake valve 2, achieving variable control of the valve lift amount in accordance with the engine operating conditions.

As shown in FIG. 16, cams 41–43 are of the raindrop-like profile, and are different in size with lift portions 41*a*, 42*a*, 43*a* formed to be smaller in this order and ramp portions 41*b*, 42*b*, 43*b* shaped differently. Specifically, ramp portion 42*b* of medium-velocity cam 42 is shaped to provide a shorter ramp period than those provided by ramp portion 41*b* of low-velocity cam 41 and ramp portion 43*b* of high-velocity cam 43. Moreover, ramp portions 41*b*, 43*b* of low-velocity cam 41 and high-velocity cam 43 are shaped to provide a longer ramp period than that provided by ramp portion 42*b* of medium-velocity cam 42.

Therefore, in the low-rotation range, low-velocity cam 41 comes in contact with a roller follower 49 to rock main rocker arm 44, achieving opening/closing operation of intake valves 2 with small lift and long ramp period. At this instant, medium-velocity and high-velocity cams 42, 43 are in lost motion.

When entering the medium-rotation range, first sub-rocker arm 45 is coupled with main rocker arm 44 which is driven along the profile of medium-velocity cam 42, achieving opening/closing operation of intake valves 2 with medium lift and short ramp period.

When entering the high-rotation range, second rocker arm 46 is coupled with main rocker arm 44 which is driven along the profile of high-velocity cam 43, achieving opening/closing operation of intake valves 2 with high lift and long ramp period.

In the second embodiment, ramp portions 41*b*–43*b* of cams 41–43 are of the singular shape as described above, producing the same effect as that in the first embodiment. It is understood that the same effect can be obtained when adopting the features of the second embodiment to the exhaust side.

Having described the present invention with regard to the illustrative embodiments, it is noted that the present invention is not limited thereto, and various changes and modifications can be made without departing from the scope of the present invention.

The entire contents of Japanese Patent Application 2001-54172 filed Feb. 28, 2001 are incorporated hereby by reference.

What is claimed is:

1. A variable-valve-actuation (VVA) apparatus for an internal combustion engine, comprising:

a valve; and a mechanism which variably controls lift characteristics of the valve in accordance with operating conditions of the engine, wherein the lift characteristics include a ramp period which is shorter in a range of medium lift amount than in a range of small lift amount and a range of large lift amount.

2. The VVA apparatus as claimed in claim 1, wherein the ramp period is applied to an up ramp.

3. The VVA apparatus as claimed in claim 1, wherein the ramp period is applied to a down ramp.

4. The VVA apparatus as claimed in claim 1, wherein the ramp period is applied to both an up ramp and a down ramp.

5. The VVA apparatus as claimed in claim 1, wherein a ramp-lift height is constant regardless of a lift amount of the valve.

6. The VVA apparatus as claimed in claim 1, wherein a clearance of the valve is constant regardless of a lift amount of the valve.

7. The VVA apparatus as claimed in claim 1, wherein the valve comprises at least one of intake and exhaust valves.

8. The VVA apparatus as claimed in claim 1, wherein the mechanism comprises a driving shaft rotated in synchronism with a crankshaft, a crank cam fixed to the driving shaft, a cam arrangement swingably supported on the driving shaft for opening and closing the valve, a rocker arm swingably supported by the control shaft and having a first arm linked with the crank cam through a crank arm and a second arm linked with the cam arrangement, and a control mechanism which controls rotation of the control shaft in accordance with the engine operating conditions, wherein a contact position of a cam face of the cam arrangement with the valve is varied by changing a rocking fulcrum of the rocker arm in accordance with rotation of the control shaft, and wherein when the mechanism controls the valve lift characteristics to a medium lift, an angle formed by a line connecting an axis of the driving shaft and an axis of the crank cam and a line connecting the axis of the crank cam and an axis of an extension of the crank arm is established to be roughly 90° during the ramp period.

9. The VVA apparatus as claimed in claim 8, wherein the cam arrangement comprises a valve operating (VO) cam having on an outer periphery a base-circle face, a ramp face, and a lift face formed continuously.

10. The VVA apparatus as claimed in claim 8, wherein the cam arrangement comprises a plurality of cams with different profiles providing different lift amounts, and a switching mechanism which selectively switches the cams in accordance with the engine operating conditions.

11. A variable-valve-actuation (VVA) apparatus for an internal combustion engine, comprising:

a valve; and a mechanism which variably controlling lift characteristics of the valve in accordance with operating conditions of the engine, the mechanism comprising a driving shaft rotated in synchronism with a crankshaft, a crank cam fixed to the driving shaft, a cam arrangement swingably supported on the driving shaft for opening and closing the valve, a rocker arm swingably supported by the control shaft and having a first arm linked with the crank cam through a crank arm and a second arm linked with the cam arrangement, and a control mechanism which controls rotation of the control shaft in accordance with the engine operating conditions, wherein a contact position of a cam face of the cam arrangement with respect to the valve is varied by changing a rocking fulcrum of the rocker arm in accordance with rotation of the control shaft, wherein when the mechanism controls the valve lift characteristics to a medium lift, an angle formed by a line connecting an axis of the driving shaft and an axis of the crank cam and a line connecting the axis of the crank cam and an axis of an extension of the crank arm is established to be roughly 90° during the ramp period, and wherein the lift characteristics include a ramp period which is shorter in a range of medium lift amount than in a range of small lift amount and a range of large lift amount.

12. The VVA apparatus as claimed in claim 11, wherein the ramp period is applied to an up ramp.

13. The VVA apparatus as claimed in claim 11, wherein the ramp period is applied to a down ramp.

14. The VVA apparatus as claimed in claim 11, wherein the ramp period is applied to both an up ramp and a down ramp.

15. The VVA apparatus as claimed in claim 11, wherein a ramp-lift height is constant regardless of a lift amount of the valve.

16. The VVA apparatus as claimed in claim 11, wherein a clearance of the valve is constant regardless of a lift amount of the valve.

17. The VVA apparatus as claimed in claim 11, wherein the valve comprises at least one of intake and exhaust valves.

18. The VVA apparatus as claimed in claim 11, wherein the cam arrangement comprises a valve operating (VO) cam having on an outer periphery a base-circle face, a ramp face, and a lift face formed continuously.

19. The VVA apparatus as claimed in claim 11, wherein the cam arrangement comprises a plurality of cams with different profiles providing different lift amounts, and a switching mechanism which selectively switches the cams in accordance with the engine operating conditions.

* * * * *